US005577007A

United States Patent [19]

Houlihan

[11] Patent Number: 5,577,007

[45] Date of Patent: Nov. 19, 1996

[54] LUGS FOR A WRIST-CARRIED INSTRUMENT

[75] Inventor: John T. Houlihan, Southbury, Conn.

[73] Assignee: Timex Corporation, Middlebury, Conn.

[21] Appl. No.: 608,350

[22] Filed: Feb. 28, 1996

[51] Int. Cl.[6] ..... G04B 37/00; A44C 5/00

[52] U.S. Cl. ..... 368/282; 224/164

[58] Field of Search ..... 368/281–282, 368/276; 224/164–170

[56] References Cited

U.S. PATENT DOCUMENTS

| | | | |
|---|---|---|---|
| 2,028,791 | 1/1936 | Lynds | 224/4 |
| 2,226,138 | 12/1940 | Prestinari | 58/88 |
| 2,559,238 | 7/1951 | Wallin | 368/282 |
| 2,820,275 | 1/1958 | Lancaster | 24/265 |
| 3,165,884 | 1/1965 | Guinner et al. | 368/282 |
| 4,414,719 | 11/1983 | Capolupo | 224/164 |
| 4,722,179 | 2/1988 | Tesch | 59/82 |
| 4,847,820 | 7/1989 | Thinesen et al. | 368/282 |
| 5,197,046 | 3/1993 | Siu | 368/282 |
| 5,363,351 | 11/1994 | Carney | 368/282 |

*Primary Examiner*—Vit W. Miska
*Attorney, Agent, or Firm*—William C. Crutcher

[57] ABSTRACT

A wrist-carried instrument has a case with a "6 o'clock" end and a "12 o'clock" end, a band with a first attachment end and a second attachment end, and a first pivoting lug member and a second pivoting lug member. The first and the second pivoting lug members encircle a predetermined portion of the case at the "6 o'clock" end and the "12 o'clock" end, respectively. The first pivoting lug member includes a first pair of arms for pivotably attaching the first pivoting lug member to the case and a second pair of arms for connecting the first attachment end of the band therebetween. The second pivoting lug member includes a first pair of arms for pivotably attaching the second pivoting lug member to the case and a second pair of arms for connecting the second attachment end of the band therebetween. In this manner, the first and the second pivoting lug members are free to pivot about the case to permit the wrist-carried instrument to conform to the contours of a wrist about which it is worn.

18 Claims, 2 Drawing Sheets

LUGS FOR A WRIST-CARRIED INSTRUMENT

This invention relates to improved lugs attached to the casing of a wrist-carried instrument which permit the wrist-carried instrument to better conform to the contours of the wrist.

BACKGROUND OF THE INVENTION

FIG. 1 illustrates the cross-section of a human wrist 2 upon which is worn an archetypal wrist-carried instrument 4, e.g., watch or pager. The prior art wrist-carried instrument 4 typically includes a case 6 with a first pair of conventional spaced attachment lugs 8 fixedly secured on the "6 o'clock" end of the case 6 and a second pair of conventional spaced attachment lugs 10 fixedly secured on the "12 o'clock" end of the case 6 when viewed from a location indicated by reference numeral 12. ("O'clock" positions will be used herein to refer to positions on the wrist-carried instrument as viewed by the wearer. Note that this analog timepiece terminology is intended to indicate positions with respect to all wrist-carried instruments, not just analog timepieces.) The case 6 is held on the wrist 2 by means of a band 14, which is shown here as comprising two separate sections connected by a buckle 16. The band 14 has a first attachment end 18 and a second attachment end 20 which are respectively, pivotably connected between the first and second pairs of attachment lugs 8 and 10 by means of pins or spring bars 22 and 24 extending through the ends 18 and 20 of the band 14. Although the band 14 in FIG. 1 is shown being pivotably connected to the attachment lugs 8 and 10 by pins or spring bars 22 and 24, the first and the second attachment ends 18 and 20 of the band 14 may also be directly affixed to the attachment lugs 8 and 10 so that there is no need for connecting means.

As is apparent from FIG. 1, the placement of the lugs 8 and 10 on the "6 o'clock" and the "12 o'clock" ends of the case 6 serves to increase the size of the case 6 vis-à-vis the wearer's wrist 2. Therefore, if the case 6 of the wrist-carried instrument 4 is already large relative to the wearer's wrist 2, the placement of the lugs 8 and 10 on the "6 o'clock" and the "12 o'clock" ends of the case 6 only exacerbates the poor fit of the wrist-carried instrument 4 about the wearer's wrist 2 by increasing the gaps between the bottom of the case 6 (along with the lugs 8 and 10 and the first and the second attachment ends 18 and 20) and the wrist 2. And given the state of today's technology, there is no shortage of wrist-carried instruments with large cases (e.g., a multimode electronic watch having capabilities of a small computer). Thus, it is the object of the present invention to provide an improved wrist-carried instrument with a case and a band which will conform to the contours of a wearer's wrist, regardless of the size of the case.

SUMMARY OF THE INVENTION

Briefly stated, this invention relates to an improved wrist-carried instrument of the type having a case with a "6 o'clock" end and a "12 o'clock" end and a band with a first attachment end and a second attachment end, wherein the improvement comprises a first pivoting lug member comprising a first pair of arms encircling a predetermined portion of the case at the "6 o'clock" end and a second pair of arms connecting the first attachment end of the band therebetween; a second pivoting lug member comprising a first pair of arms encircling a predetermined portion of the case at the "12 o'clock" end and a second pair of arms connecting the second attachment end of the band therebetween; first attaching means for pivotably attaching the first pair of arms of the first pivoting lug member to the case so that the first pivoting lug member is adapted to freely pivot about the case to permit the wrist-carried instrument to conform to the contours of a wrist about which it is worn; and second attaching means for pivotably attaching the first pair of arms of the second pivoting lug member to the case so that the second pivoting lug member is adapted to freely pivot about the case to permit the wrist-carried instrument to conform to the contours of the wrist about which it is worn.

BRIEF DESCRIPTION OF THE DRAWINGS

The invention, both as to organization and to method of practice, together with further objects and advantages thereof, will best be understood by reference to the following specification, taken in connection with the accompanying drawings, in which.

DETAILED DESCRIPTION OF THE PREFERRED EMBODIMENT

Figure 1:
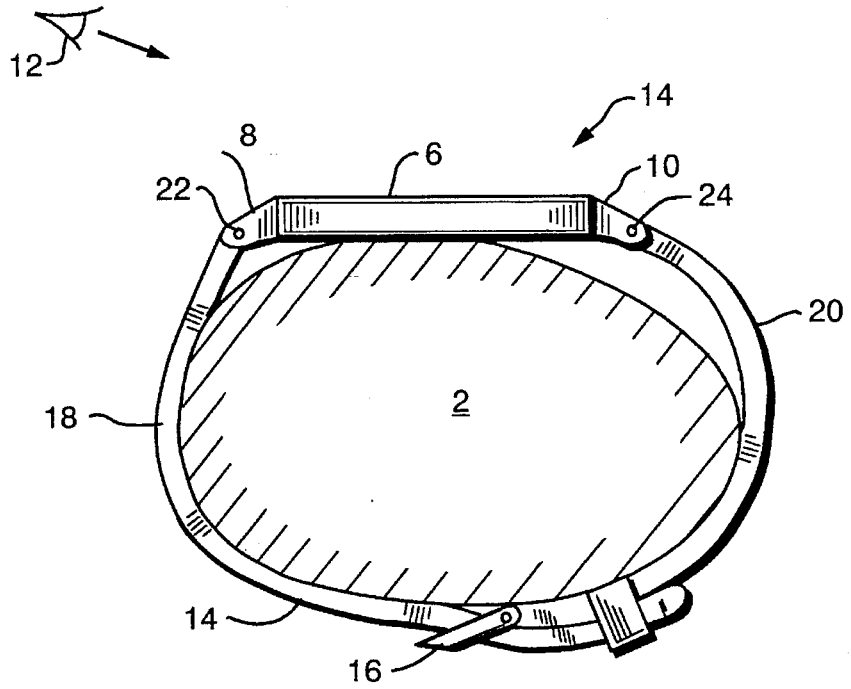
FIG. 1 (PRIOR ART)
FIG. 1 is a side view of a prior art wrist-carried instrument on a wearer's wrist, the latter shown in cross section.
Figure 2:
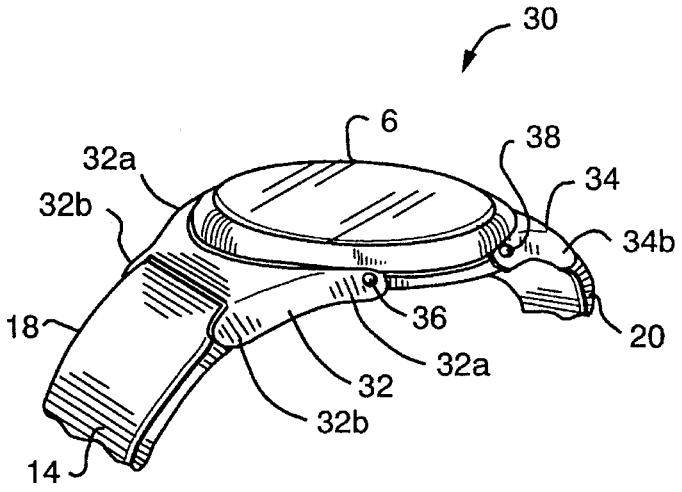
FIG. 2 is a perspective view of an improved wrist-carried instrument in accordance with the preferred embodiment of the present invention.

FIG. 2 is a perspective view of the improved wrist-carried instrument, generally indicated by reference numeral 30, in accordance with the preferred embodiment of the present invention. The wrist-carried instrument 30 generally comprises a case 6 and a band 14 (only a portion of which is shown) having a first attachment end 18 and a second attachment end 20, in accordance with the prior art. However, unlike the archetypal prior art wrist-carried instrument 4 of FIG. 1, the improved wrist-carried instrument 30 of the present invention includes a first pivoting lug member 32 and a second pivoting lug member 34 pivotably attached to the case 6.

The first pivoting lug member 32 comprises a first pair of arms **32*a* for pivotably attaching the first pivoting lug member 32 to the case 6 and a second pair of arms 32*b* for pivotably connecting the first attachment end 18 of the band 14 therebetween. The first pair of arms 32*a* are preferably attached to the case 6 by means of pins or screws 36 and 37 extending through an aperture in each arm 32*a*. The second pair of arms 32*b* pivotably connect the first attachment end 18 of the band 14** therebetween preferably by means of a pin or a spring bar, in accordance with the prior art.

The second pivoting lug member 34 comprises a first pair of arms **34*a* for pivotably attaching the second pivoting lug member 34 to the case 6 and a second pair of arms 34*b* for pivotably connecting the second attachment end 20 of the band 14 therebetween. The first pair of arms 34*a* are preferably attached to the case 6 by means of pins or screws 38 and 39 extending through an aperture in each arm 34*a*. The second pair of arms 34*b* pivotably connect the second attachment end 20 of the band 14** therebetween preferably by means of a pin or a spring bar, in accordance with the prior art.

Figure 3:
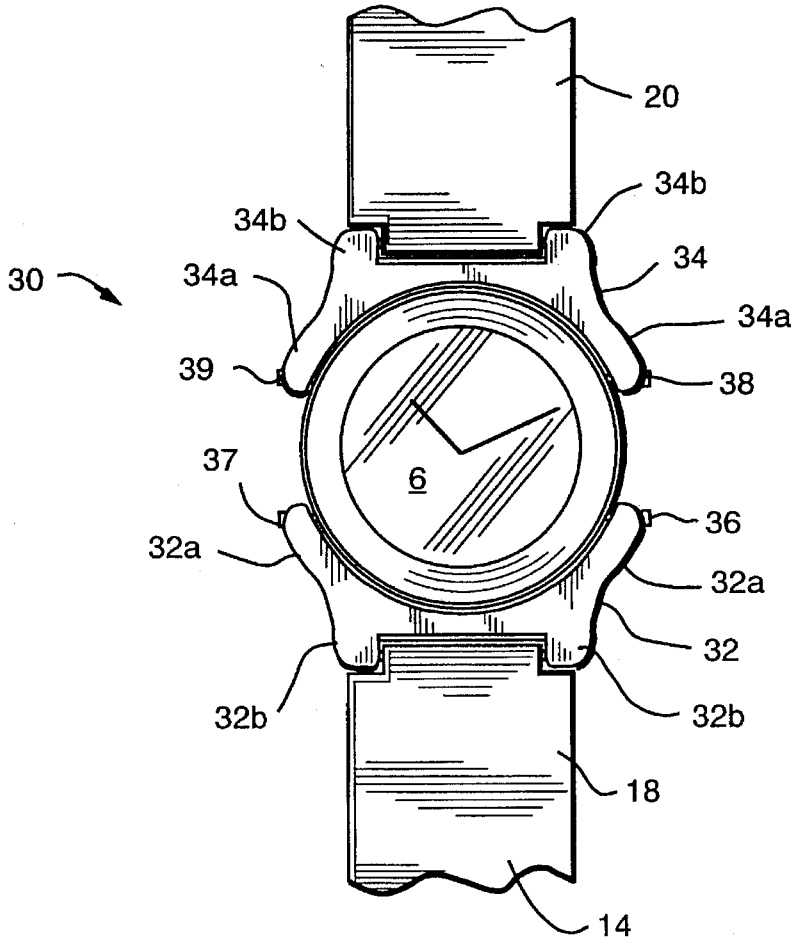
FIG. 3 is a plan view of the improved wrist-carried instrument of the present invention, with the wrist-carried instrument shown as an analog wristwatch.

Note that unlike prior art lugs, such as the first and the second pairs of spaced attachment lugs 8 and 10 of FIG. 1, the first and the second pivoting lug members 32 and 34 are not fixedly secured on the "6 o'clock" and the "12 o'clock" ends of the case 6. Instead, the first pair of arms 32*a* for the first pivoting lug member 32 are pivotably attached near the "4 o'clock" and the "8 o'clock" positions on the case 6, and the first pair of arms 34*a* for the second pivoting lug member 34 are pivotably attached near the "2 o'clock" and the "10 o'clock" positions on the case 6. This is better illustrated by FIG. 3, which is a plan view of the improved wrist-carried instrument 30 of the present invention. The wrist-carried instrument 30 is shown in FIG. 3 as an analog wristwatch for purposes of better clarifying the "o'clock" positions on the case 6. Although in the preferred embodiment, the first pair of arms 32*a* for the first pivoting lug member 32 are shown attached to the case 6 near the "4 o'clock" and the "8 o'clock" positions and the first pair of arms 34*a* for the second pivoting lug member 34 are shown attached to the case 6 near the "2 o'clock" and the "10 o'clock" positions, the attachment of the first pairs of arms 32*a* and 34*a* at these positions is by no means an indispensable element of the invention. As a matter of fact, where there is a need to locate a plurality of push buttons on the "3 o'clock" and the "9 o'clock" sides of the case 6 (as would be the case for a multimode electronic wristwatch), it would be preferred to attach the first pair of arms 32*a* for the first pivoting lug member 32 near the "5 o'clock" and the "7 o'clock" positions and the first pair of arms 34*a* for the second pivoting lug member 34 near the "1 o'clock" and the "11 o'clock" positions since this would leave more available space on the case 6 for purposes of locating the push buttons. The important thing about the "o'clock" positions of the first pair of arms 32*a* for the first pivoting lug member 32 and the first pair of arms 34*a* for the second pivoting lug member 34 is that they not be at the "6 o'clock" and the "12 o'clock" positions, respectively.

Furthermore, the first and the second pivoting lug members 32 and 34 are each shaped to conform to the contour of the part of the case 6 to which it is attached. Thus, as is apparent from FIGS. 2 and 3, the shape of each lug member 32 or 34 between the first pair of arms 32*a* or 34*a* conforms to the contour of the part of the case 6 which it encircles.

Figure 4:
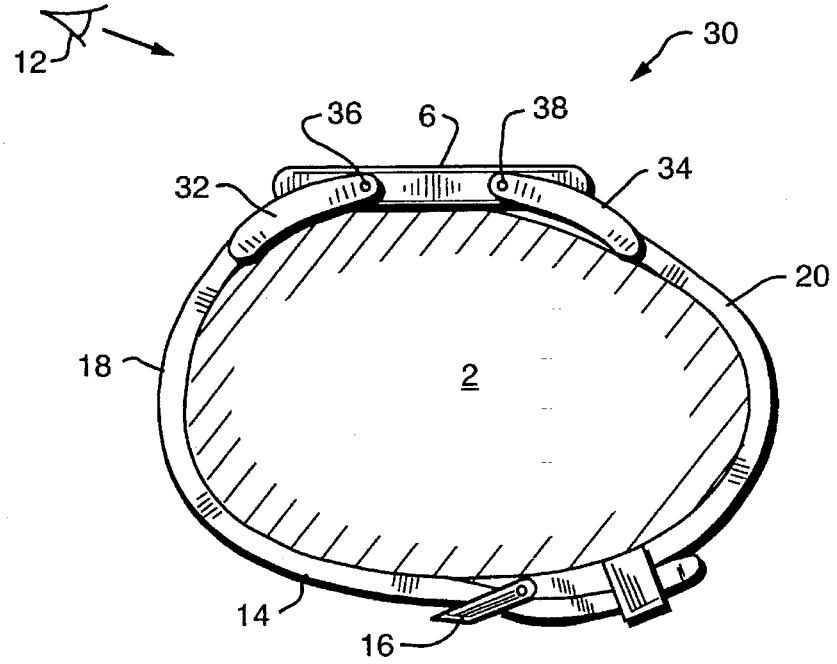
FIG. 4 is a side view of the improved wrist-carried instrument of the present invention on a wearer's wrist, the latter shown in cross section.

The improved wrist-carried instrument 30 realizes the objects of the present invention in the following manner. When the improved wrist-carried instrument 30 is worn about the wrist 2, the first and the second pivoting lug members 32 and 34 pivot with respect to the case 6 to provide a secure, yet comfortable fit about the wrist 2. This is illustrated in FIG. 4, where the first and the second pivoting lug members 32 and 34 are shown in a shifted down position. By shifting down, the first and the second pivoting lug members 32 and 34 minimize the gaps between the bottom of the case 6 (along with the first and the second attachment ends 18 and 20) and the wrist 2. In comparison to the prior art wrist-carried instrument 4 of FIG. 1, it is apparent that the improved wrist-carried instrument 30 provides a much better fit about the wrist 2. Note that there must be an appropriate, small gap between each lug member 32 or 34 and the part of the case 6 which the lug member 32 or 34 encircles so that the lug member 32 or 34 can freely pivot about the case 6.

While there has been described what is considered the preferred embodiment of the invention, modifications of the present invention will occur to those skilled in the art, and it is desired to secure in the appended claims all such modifications as fall within the true spirit and scope of the invention.

I claim:

1. An improved wrist-carried instrument of the type having a case with a "6 o'clock" end and a "12 o'clock" end and a band with a first attachment end and a second attachment end, wherein the improvement comprises:

a first pivoting lug member comprising a first pair of arms encircling a predetermined portion of the case at the "6 o'clock" end and a second pair of arms connecting the first attachment end of the band therebetween;

a second pivoting lug member comprising a first pair of arms encircling a predetermined portion of the case at the "12 o'clock" end and a second pair of arms connecting the second attachment end of the band therebetween;

first attaching means for pivotably attaching the first pair of arms of the first pivoting lug member to the case so that the first pivoting lug member is adapted to freely pivot about the case to permit the wrist-carried instrument to conform to the contours of a wrist about which it is worn; and second attaching means for pivotably attaching the first pair of arms of the second pivoting lug member to the case so that the second pivoting lug member is adapted to freely pivot about the case to permit the wrist-carried instrument to conform to the contours of the wrist about which it is worn.

2. The improved wrist-carried instrument according to claim 1, wherein the second pair of arms for the first and the second pivoting lug members are connected to the first and the second attachment ends, respectively, by pins.

3. The improved wrist-carried instrument according to claim 1, wherein the second pair of arms for the first and the second pivoting lug members are connected to the first and the second attachment ends, respectively, by spring bars.

4. The improved wrist-carried instrument according to claim 1, wherein the first attaching means and the second attaching means comprise pins.

5. The improved wrist-carried instrument according to claim 1, wherein the first attaching means and the second attaching means comprise screws.

6. The improved wrist-carried instrument according to claim 1, wherein the predetermined portion of the case at the "6 o'clock" end comprises a peripheral portion of the case substantially encompassing from a "4 o'clock" position to an "8 o'clock" position.

7. The improved wrist-carried instrument according to claim 1, wherein the predetermined portion of the case at the "12 o'clock" end comprises a peripheral portion of the case substantially encompassing from a "10 o'clock" position to a "2 o'clock" position.

8. The improved wrist-carried instrument according to claim 1, wherein the predetermined portion of the case at the "6 o'clock" end comprises a peripheral portion of the case substantially encompassing from a "5 o'clock" position to a "7 o'clock" position.

9. The improved wrist-carried instrument according to claim 1, wherein the predetermined portion of the case at the "12 o'clock" end comprises a peripheral portion of the case substantially encompassing from an "11 o'clock" position to a "1 o'clock" position.

10. A wrist-carried instrument comprising:

a case having a "6 o'clock" end and a "12 o'clock" end and having at least one push button for operating the wrist-carried instrument;

a band having a first attachment end and a second attachment end;

a first pivoting lug member comprising a first pair of arms encircling a predetermined portion of the case at the "6 o'clock" end and a second pair of arms connecting the first attachment end of the band therebetween;

a second pivoting lug member comprising a first pair of arms encircling a predetermined portion of the case at the "12 o'clock" end and a second pair of arms connecting the second attachment end of the band therebetween;

first attaching means for pivotably attaching the first pair of arms of the first pivoting lug member to the case so that the first pivoting lug member is adapted to freely pivot about the case to permit the wrist-carried instrument to conform to the contours of a wrist about which it is worn; and second attaching means for pivotably attaching the first pair of arms of the second pivoting lug member to the case so that the second pivoting lug member is adapted to freely pivot about the case to permit the wrist-carried instrument to conform to the contours of the wrist about which it is worn.

11. The wrist-carried instrument according to claim 10, wherein the second pair of arms for the first and the second pivoting lug members are connected to the first and the second attachment ends, respectively, by pins.

12. The wrist-carried instrument according to claim 10, wherein the second pair of arms for the first and the second pivoting lug members are connected to the first and the second attachment ends, respectively, by spring bars.

13. The wrist-carried instrument according to claim 10, wherein the first attaching means and the second attaching means comprise pins.

14. The wrist-carried instrument according to claim 10, wherein the first attaching means and the second attaching means comprise screws.

15. The wrist-carried instrument according to claim 10, wherein the predetermined portion of the case at the "6 o'clock" end comprises a peripheral portion of the case substantially encompassing from a "4 o'clock" position to an "8 o'clock" position.

16. The wrist-carried instrument according to claim 10, wherein the predetermined portion of the case at the "12 o'clock" end comprises a peripheral portion of the case substantially encompassing from a "10 o'clock" position to a "2 o'clock" position.

17. The wrist-carried instrument according to claim 10, wherein the predetermined portion of the case at the "6 o'clock" end comprises a peripheral portion of the case substantially encompassing from a "5 o'clock" position to a "7 o'clock" position.

18. The wrist-carried instrument according to claim 10, wherein the predetermined portion of the case at the "12 o'clock" end comprises a peripheral portion of the case substantially encompassing from an "11 o'clock" position to a "1 o'clock" position.

* * * * *